US009879520B2

(12) United States Patent
Fanini et al.

(10) Patent No.: US 9,879,520 B2
(45) Date of Patent: Jan. 30, 2018

(54) PACKAGING STRUCTURES AND MATERIALS FOR VIBRATION AND SHOCK ENERGY ATTENUATION AND DISSIPATION AND RELATED METHODS

(71) Applicant: Baker Hughes Incorporated, Houston, TX (US)

(72) Inventors: Otto N. Fanini, Houston, TX (US); Dwight W. Swett, Houston, TX (US); Edgar R. Alvarez, Houston, TX (US); Brent D. Hope, Spring, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 661 days.

(21) Appl. No.: 14/229,558

(22) Filed: Mar. 28, 2014

(65) Prior Publication Data

US 2015/0275652 A1 Oct. 1, 2015

(51) Int. Cl.
*E21B 47/01* (2012.01)

(52) U.S. Cl.
CPC ..... *E21B 47/011* (2013.01); *E21B 47/01* (2013.01)

(58) Field of Classification Search
CPC .... E21B 47/01; E21B 47/011; E21B 17/1078; E21B 36/003; F16F 9/00; F16F 9/30; F16F 9/306
See application file for complete search history.

(56) References Cited

U.S. PATENT DOCUMENTS 5,394,786 A 3/1995 Gettle et al.
5,965,249 A * 10/1999 Sutton ..... C08J 9/40 248/562
6,127,026 A 10/2000 Bonk et al.
6,668,986 B2 12/2003 Moradmand et al.
2004/0221553 A1 11/2004 Rapp
2010/0000311 A1* 1/2010 Nakajima ..... G01V 1/186 73/152.47

(Continued)

FOREIGN PATENT DOCUMENTS

EP 11106956 A1 6/2001
JP 2010238714 A 10/2010

OTHER PUBLICATIONS

PCT/US2015/022790—Interntional Search Report dated Jun. 30, 2015.

(Continued)

*Primary Examiner* — Robert E Fuller
*Assistant Examiner* — David Carroll
(74) *Attorney, Agent, or Firm* — Mossman, Kumar & Tyler, PC

(57) ABSTRACT

An apparatus for protecting a module used in a borehole may include a plurality of shock protection elements associated with the module. The plurality of shock protection elements cooperatively has a macroscopic non-linear spring response to an applied shock event. The plurality of shock protection elements may include at least an enclosure and a dampener connecting the module with the enclosure. A related method for protecting a module used in a borehole may include enclosing the module within the plurality of shock protection elements; disposing the module in the borehole; and subjecting the module to a shock event. The plurality of shock protection elements cooperatively has a macroscopic non-linear spring response to the shock event.

18 Claims, 9 Drawing Sheets

(56) References Cited

U.S. PATENT DOCUMENTS

| | | | | |
|---|---|---|---|---|
| 2010/0108306 | A1 | 5/2010 | Cooper | |
| 2013/0048375 | A1* | 2/2013 | Rodgers | E21B 43/1195 175/4.6 |
| 2013/0235537 | A1* | 9/2013 | Swett | H05K 5/0213 361/752 |
| 2014/0338439 | A1* | 11/2014 | Ligneul | E21B 47/1005 73/152.31 |
| 2015/0252666 | A1* | 9/2015 | Wang | E21B 47/011 166/66 |

OTHER PUBLICATIONS

Williamson et al., "The Physics of Springs," The Connexions Project.

R. Roos et al., "Polyurethane Foam Molding Technologies for Improving Total Passenger Compartment Comfort".

Andrysco, N., et al., "Permeable and Absorbent Materials in Fluid Simulations", EUROGRAPHICS/ACM SIGGRAPH Symposium on Computer Animation (2008).

* cited by examiner

PACKAGING STRUCTURES AND MATERIALS FOR VIBRATION AND SHOCK ENERGY ATTENUATION AND DISSIPATION AND RELATED METHODS

FIELD OF THE DISCLOSURE

This disclosure pertains generally to devices and methods for providing shock and vibration protection for wellbore devices.

BACKGROUND OF THE DISCLOSURE

Exploration and production of hydrocarbons generally requires the use of various tools that are lowered into a borehole, such as drilling assemblies, measurement tools and production devices (e.g., fracturing tools). Electronic components may be disposed downhole for various purposes, such as control of downhole tools, communication with the surface and storage and analysis of data. Such electronic components typically include printed circuit boards (PCBs) that are packaged to provide protection from downhole conditions, including temperature, pressure, vibration and other thermo-mechanical stresses.

In one aspect, the present disclosure addresses the need for enhanced shock and vibration protection for electronic components and other shock and vibration sensitive devices used in a wellbore.

SUMMARY OF THE DISCLOSURE

In aspects, the present disclosure provides an apparatus for protecting a module used in a borehole. The apparatus may include a plurality of shock protection elements associated with the module. The plurality of shock protection elements cooperatively have a macroscopic non-linear spring response to an applied shock event. The plurality of shock protection elements may include at least an enclosure and a dampener connecting the module with the enclosure.

In aspects, the present disclosure provides a method for protecting a module used in a borehole. The method may include enclosing the module within a plurality of shock protection elements, wherein the plurality of shock protection elements includes at least: an enclosure and a dampener connecting the module with the enclosure; disposing the module in the borehole; and subjecting the module to a shock event, wherein the plurality of shock protection elements cooperatively have a macroscopic non-linear spring response to the shock event.

Examples of certain features of the disclosure have been summarized rather broadly in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

Drilling conditions and dynamics produce sustained and intense shock and vibration events. These events can induce electronics failure, fatigue, and accelerated aging in the devices and components used in a drill string. In aspects, the present disclosure provides devices and methods for protecting these components from the energy associated with such shock events. Embodiments of the present disclosure may use layered, graded, and/or damping structures combined with structural elements and materials to achieve macroscopic non-linear spring behavior, attenuation, and dissipation. These structures can protect sensors, electronics and assemblies from vibration and shock energy. In some embodiments, the layers could exhibit elastomeric, viscoelastic, damping, or hydropneumatic characteristics. The structures and methods of the present disclosure can minimize structural damage, elastic deformation limitations, and cyclic fatigue due to deformation by limiting the instantaneous mechanical power (P(t)) level coupled to the structure during shock events and random vibrations.

Figure 1:
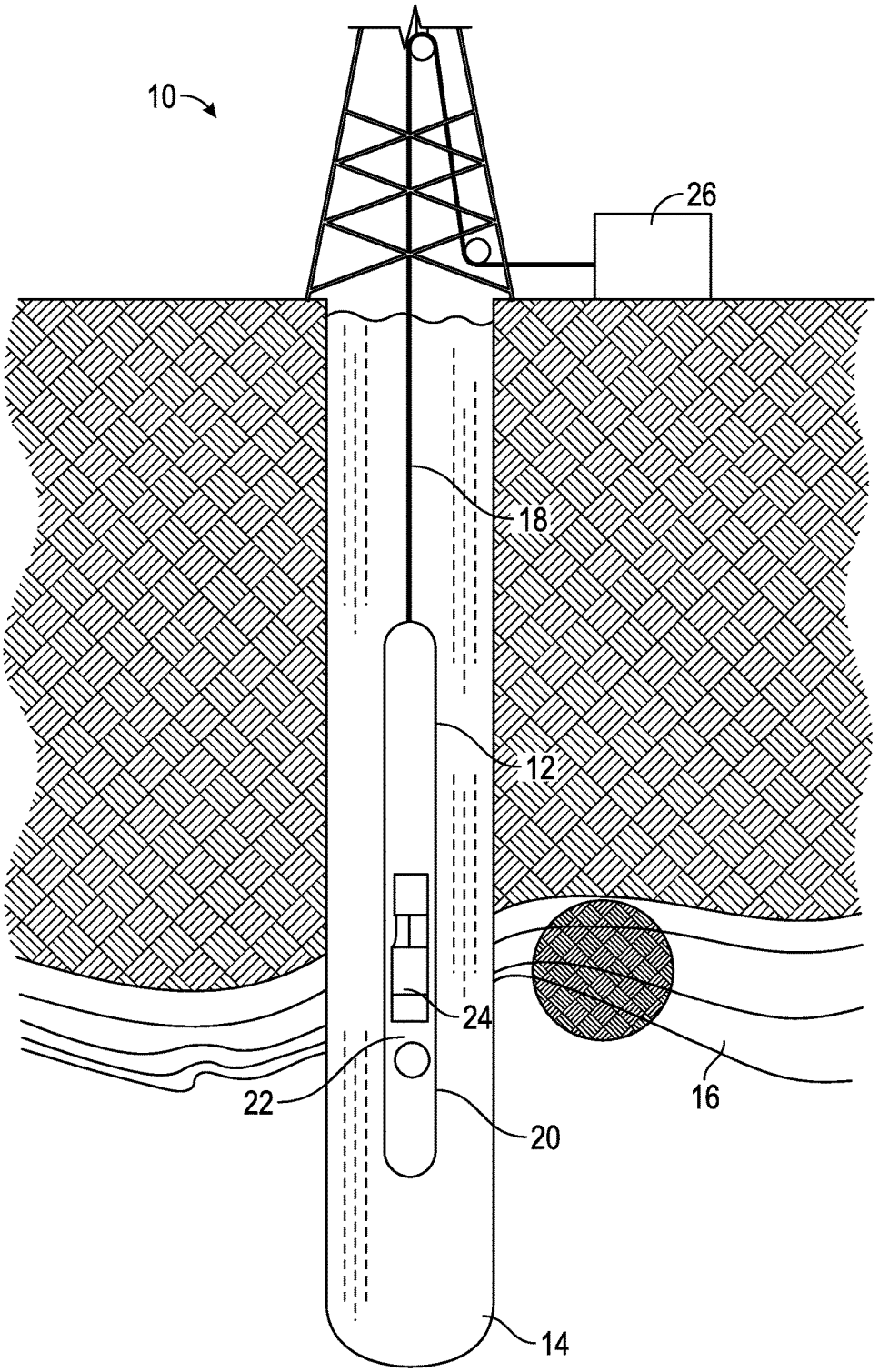
FIG. 1 shows a schematic of a well system that may use one or more shock protectors according to the present disclosure.

Referring to FIG. 1, an exemplary embodiment of a well logging, production and/or drilling system 10 includes a conveyance device such as a borehole string 12 that is shown disposed in a borehole 14 that penetrates at least one earth formation 16 during a drilling, well logging and/or hydrocarbon production operation. The conveyance device can include one or more pipe sections, coiled tubing forming segments of a tool string, a downhole tractor, or a drop tool. In one embodiment, the system 10 also includes a bottomhole assembly (BHA) 20. In one embodiment, the BHA 20, or other portion of the borehole string 12, includes a drilling assembly and/or a measurement assembly such as a downhole tool 22 configured to estimate at least one property of the formation 14, the BHA 20, and/or the borehole string 12.

The tool 22 is connected to suitable electronics for receiving sensor measurements, storing or transmitting data, analyzing data, controlling the tool and/or performing other functions. Such electronics may be incorporated downhole in an electronics module 24 incorporated as part of the tool 22 or other component of the string 12, and/or a surface processing unit 26. In one embodiment, the electronics module 24 and/or the surface processing unit 26 includes components as necessary to provide for data storage and processing, communication and/or control of the tool 22. Exemplary electronics in the electronics module include printed circuit board assemblies (PCBA) and multiple chip modules (MCM's).

The module 24 can be a BHA's tool instrument module which can be a crystal pressure or temperature detection, or frequency source, a sensor acoustic, gyro, accelerometer, magnetometer, etc., sensitive mechanical assembly, MEM, multichip module MCM, Printed circuit board assembly PCBA, flexible PCB Assembly, Hybrid PCBA mount, MCM with laminate substrate MCM-L, multichip module with ceramic substrate e.g. LCC or HCC, compact Integrated Circuit IC stacked assemblies with ball grid arrays or copper pile interconnect technology, etc. All these types of modules 24 often are made with fragile and brittle components which cannot take bending and torsion forces and therefore benefit from the protection of the package housing and layered protection described below.

Exemplary structures for protecting shock and vibration sensitive equipment such as the electronics module 24 (FIG. 1) are described below. For ease of discussion, such structures will be referred to as shock protectors. It should be understood, however, that these structures are equally effective at protecting equipment from vibrations. Although the embodiments described herein are discussed in the context of electronics modules, the embodiments may be used in conjunction with any component that would benefit from a structure having high damping, high thermal conduction, and/or low fatigue stress. Furthermore, although embodiments herein are described in the context of downhole tools, components and applications, the embodiments are not so limited.

Figure 2A:
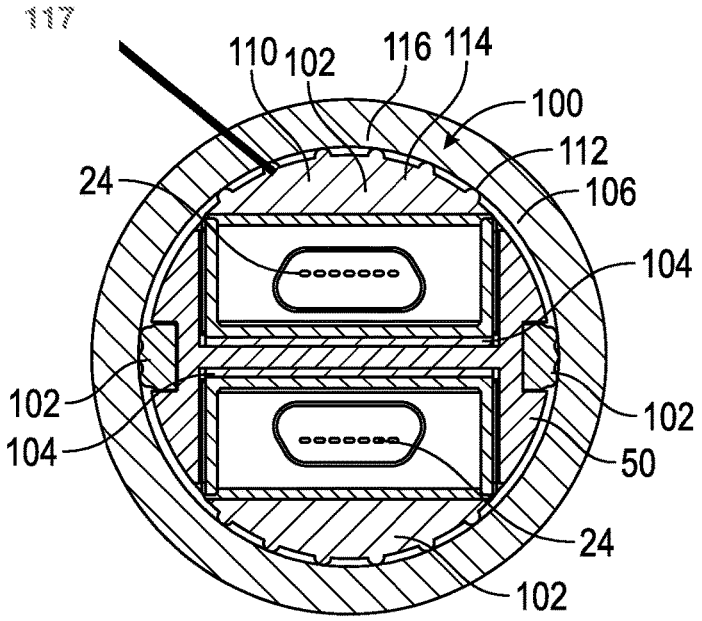
FIG. 2A schematically illustrates one embodiment of a shock protector that uses elongated supports according to the present disclosure.
Figure 2B:
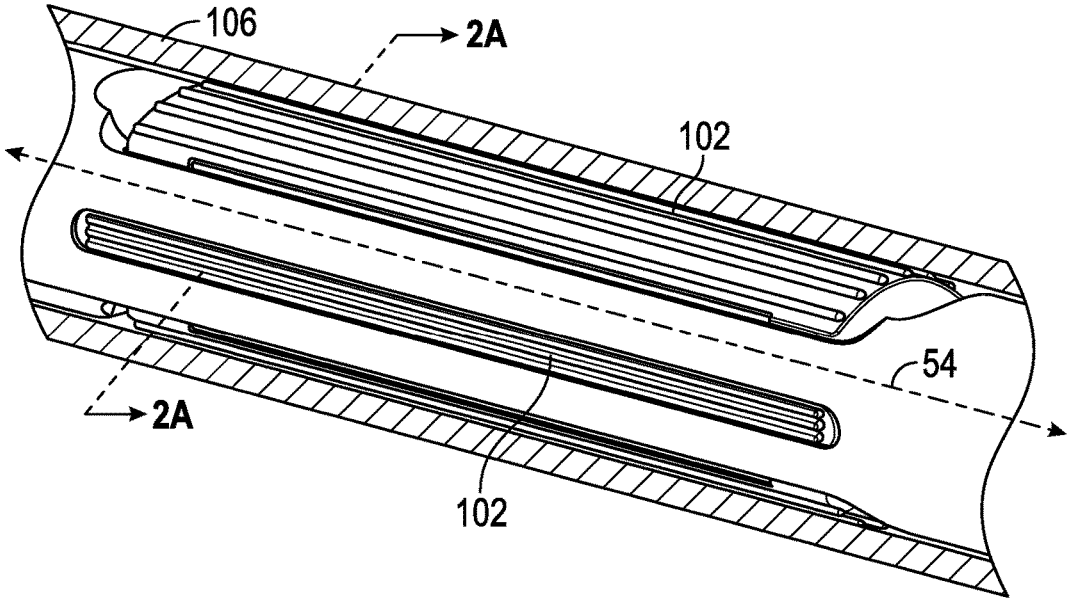
FIG. 2B isometrically illustrates the FIG. 2A shock protector.

FIGS. 2A-B sectionally illustrate one embodiment of a shock protector 100 for protecting a pair of modules 24 from shock and vibrations. FIG. 2A is a sectional view of the shock protector 100 that is isometrically shown in FIG. 2B. The modules 24 may be secured in a chassis 50 formed as an "H-beam." The shock protector 100 may include plurality of resilient supports 102 that are distributed around the chassis 50 and one or more pads 104 inserted between each module 24 and the chassis 50. In this non-limiting embodiment, two pairs of differently sized supports 102 are used. As used herein, the term "resilient" refers to a connection wherein the material has an elastic deformation zone and a plastic deformation zone and wherein the elastic deformation zone has the ability to absorb/dissipate at least a portion of the energy associated with a shock event. A pressure barrel 106 encloses the shock protector 100 and the modules 24. The shock protector 100 and associated electronics module 24 are positioned inside the bore of a string 12 (FIG. 1) such that drilling mud flow surrounds and immerses the pressure barrel 106.

In one arrangement, the supports 102 form a resilient connection between the module 24 and the pressure barrel 106. Thus, in one sense, the module 24 may be considered to be suspended in the pressure barrel 106 by the supports 102. The supports 102 may be formed as strips that are elongated along a longitudinal tool axis 54 (FIG. 2B). The axial length of the supports 102 may be selected to resist tool body motion at "anti-nodes." During operation, sinusoidal waves may propagate along the drill string 12 (FIG. 1) and BHA 20 (FIG. 1). These waves cause the drill string 12 (FIG. 1) and BHA 20 (FIG. 1) to be laterally displaced relative to the axis 54 (FIG. 2B). Locations of maximum displacement (or amplitude) are referred to as anti-nodes. In one arrangement, methods such as simulations or test runs may be used to locate the anti-nodes along the BHA 20 (FIG. 1) and to determine the resonance and transmissibility. The supports 102 may be placed along the length to provide stiffness and dampening for the module 24. For example, the supports 102 may have an axial length sufficient to prevent the pressure barrel 106 from pivoting about the compressive contact point at the supports 102.

In embodiments, the supports 102 may be circumferentially arrayed around and fixed to the chassis 50. For example, the supports 102 may be phased at ninety degree intervals as shown. While four supports 102 are shown, a greater or a fewer number of supports may be used. In embodiments, the supports 102 are symmetrically arranged such that opposing supports 102 can work cooperatively to attenuate and dissipate shock and vibration energy.

The support 102 may include a body 110 and a plurality of ribs 112 disposed on an outer surface 114. The height of the ribs 112 is greater than the clearance space between the outer surface 114 and an interior surface 116 of the pressure housing 106. Thus, the ribs 112 compress and cause a pre-determined amount of pre-loading on the body 110 after the module 24 has been inserted into the pressure housing 106. Additionally, the shape and the volume of the body 110 may be selected to induce primarily shear stresses during shock events. In the embodiment shown, the body 110 has a domed portion 117 having a mass selected to absorb the shear strain associated with the anticipated shock events. Additionally, the ribs 112 and the body 110 may be shaped to generate a relatively high shear strain as opposed to a pure compressive loading in the body 110.

In one embodiment, the supports 102 are formed of a composite material that exhibits high damping behavior. Suitable materials for the support 102 have an elastic modulus in the range of 100 to about 200 MPa such as Dow Corning's 1-4173. One non-limiting suitable material has glass fibers in an elastomeric binder. The composite material is a high temperature material whose performance is not affected by high temperatures.

The pressure barrel 106 acts as a protective enclosure for the electronics module 24 (hereafter "module") and may be formed of a relatively hard material such as a metal. The pad 104 may be configured in one embodiment as a visco-elastic damping pad or damping layer that is disposed between the module 24 and the chassis 50. The viscoelastic material has a stiffness corresponding to an elastic modulus that is in the range of, e.g., about 0.5 to about 5 MPa. An exemplary viscoelastic material is a polymer or elastomer such as DOW CORNING 3-6651 thermally conductive elastomer.

It should be appreciated that the FIG. 2A embodiment uses a layered structure for managing shock events. Initially, the pressure barrel 106 absorbs some of the shock energy and communicates the remainder to the supports 102. The compressive contact at the ribs 112 causes this shock energy to generate shear strain in the body 110. The material of the body 110 dampens the shock before the shock energy is transmitted to the chassis 50 and the module 24. Further dampening is provided by the pads 104, which dampen the movement of the module 24. It should be appreciate that the above-described embodiment minimizes the scalar product of the force vector generated by the shock event and the velocity vector of the module 24. Thus, external kinetic energy is absorbed and dissipated away from the module 24. As should also be appreciated, the geometry, materials, and positioning of each of these elements may be configured as needed to attenuate and dissipate the anticipated shock and vibration energy.

Figure 3A:
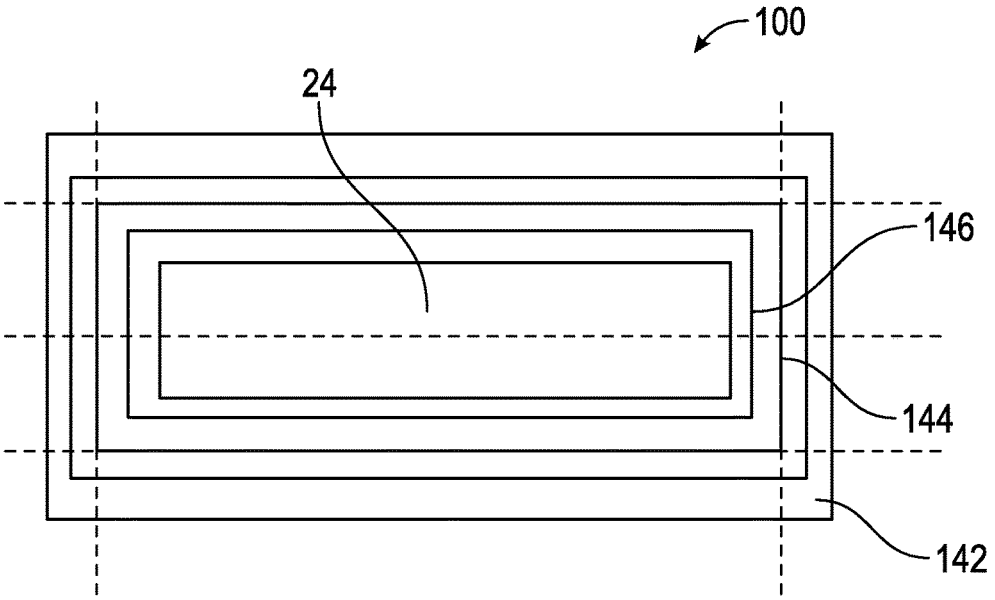
FIG. 3A schematically illustrates one embodiment of a shock protector that uses multiple shock absorbing and attenuating layers according to the present disclosure.

Referring now to FIG. 3A, there is shown another embodiment of the present disclosure that uses a shock protector 100 that includes multiple layers 142, 144, 146 that partially or completely surround the module 24. By partially surround, it is meant enclosing at least two sides of the module 24. By completely surround, it is meant enclosing all sides of the module 24, but having what passages are needed to allow wiring to enter and connect to the module 24. At least one of the layers 142-146 may be resilient. The layers 142-146 may be symmetric, continuously graded, or have discrete steps. Each layer 142-146 may have distinct damping and visco-elastic properties that allow the layers 142-146 to cooperatively protect the module 24 from impact and vibration.

The layers 142-146 may be configured to exhibit a composite non-linear spring behavior. The geometry and material for each layer 142-146 may be designed to respond to different ranges of the shock (transient) and vibration (random) frequency spectrum. Further, the layers 142-146 may be constructed such that they are energized and compressed sequentially during the shock event. The serial and sequential action of layers 142-146 with varying viscoelastic and damping characteristics may produce a nonlinear macroscopic damping spring effect. Thus, these shock protection elements/layers cooperatively have a macroscopic non-linear spring response to an applied shock event.

Figure 3B:
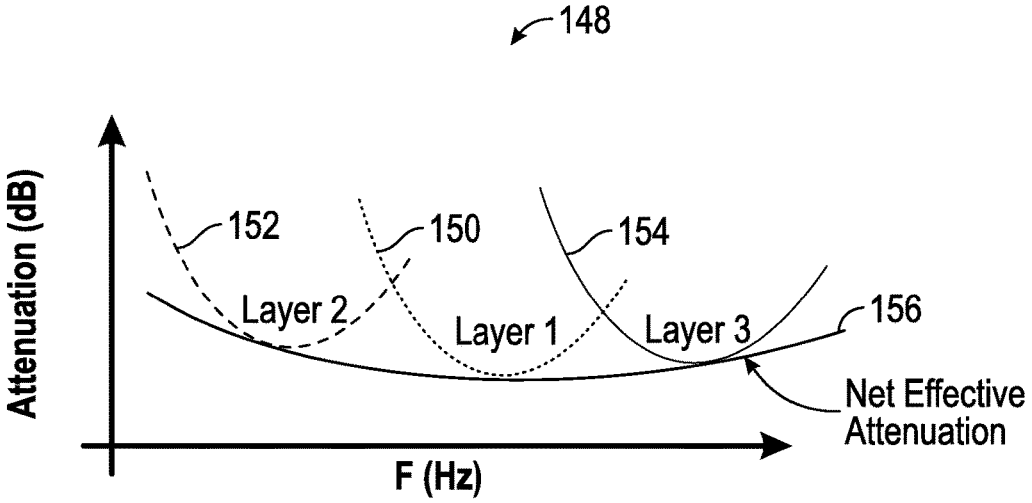
FIG. 3B shows a graph of a representative behavior of the FIG. 3A shock protector during a shock event.

The representative behavior of each layer 142-146 in response to an applied shock energy is illustrated in the graph 148 of FIG. 3B. Graph 148 shows frequency (Hz) along the "x-axis" and effective attenuation of shock and vibration (dB) along the "y-axis." The graph 148 further illustrates the response of three layers 142, 144, 146 to an applied shock event. Each layer 142, 144, 146 is configured to have a different response as shown by lines 150, 152, 154, respectively. However, the responses 150, 152, 154, in the aggregate result in a net effective attenuation shown by line 156. Line 156 illustrates the external package surface interaction to internal module's structure isolation.

The different responses may be obtained by varying one or more material properties or geometric properties: e.g., thickness, volumetric mass density, stiffness, dampening, creep, relaxation, resonance peak, Q-factor, specific damping capacity, loss angle d (delta), Beta angle, free natural frequency, free decay of vibration, tensile strength at break, elongation at break, creep ratio, tensile elastic stress (% strain), compression set, compressive stress (% strain), tear strength, bulk modulus, Poisson's ratio, static and kinetic coefficient of friction, density, specific gravity, glass transition, flash ignition temperature, resilience test rebound height, dielectric strength, dynamic young modulus (frequency), tangent delta (frequency), damping ratio, bacterial and fungal resistance, chemical resistance to fluids (hydraulic, kerosene, diesel, soap solution, etc . . . ), acoustic transmission loss in air, shock absorption life cycles, damping coefficient temperature range, percent load deflection hysteresis, etc.

A representative list of suitable materials includes, but is not limited to, microlayers (e.g., 10-100 microns thick) that alternate between at least one gas barrier (e.g., pressurized bladder) material and at least one elastomeric material; a thermoset, polyether-based, polyurethane, viscoelastic material such as SORBOTHANE. As used herein, a viscoelastic material is a material having both viscous and elastic characteristics when undergoing deformation. Generally speaking, a visco-elastic material deforms at under load and transmits forces in a plurality of directions and returns to its original shape when the load is removed. The deformation is at a molecular level or, stated differently, a molecular rearrangement. Additionally, a visco-elastic material has a relatively high tangent of delta. The tangent of delta is a dimensionless term that expresses the out-of-phase time relationship between a shock event and the transfer of the force to an object. In some embodiments, the properties of a suitable viscoelastic material may be: a tensile strength at breaking of 190 to 220 PSI, a bulk modulus of 2-3 gPascal, a Poisson's Ration of 0.4 to 0.6, a Dynamics Young's Modulus between 5 to 50 Hertz of 100-300, and a Tangent Delta between 5 to 50 Hertz of 0.4-0.6.

Figure 4A:
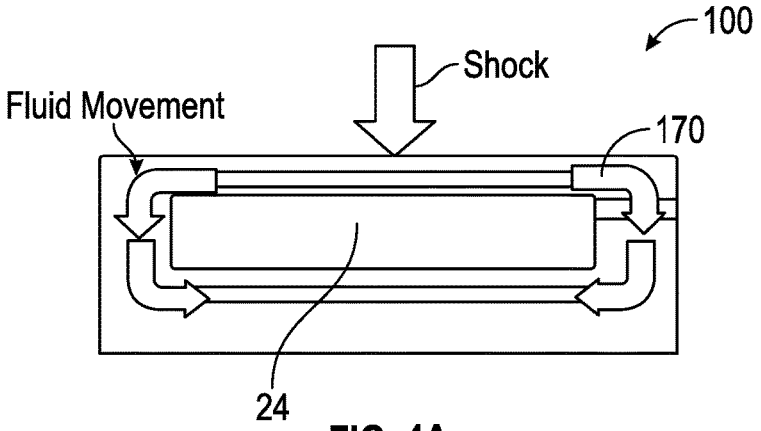
FIG. 4A schematically illustrates one embodiment of a shock protector that includes a porous media having a fluid according to the present disclosure.

Referring now to FIG. 4A, there is shown another shock protector 100 according to the present disclosure that also uses one or more layers 170 that partially or completely surround an electronics module 24. In this embodiment, at least one of the layers 170 includes a network matrix of interconnected porous spaces filled with a fluid. When subjected to an external shock or vibration, the fluid moves partially or completely around the electronics module 24 via the porous interconnected channels. By partially, it is meant the fluid flows along less than all of the sides of the module 24. By completely, it is meant the fluid completes a flow between two opposing sides of the module 24. Thus, the fluid acts as a damping hydraulic action fluid. As shown and relative to the direction of the shock event, the fluid may initially move in a non-parallel direction. The flow may switch to a flow that aligns with the direction of the shock event and then back to a non-parallel flow.

Figure 4B:
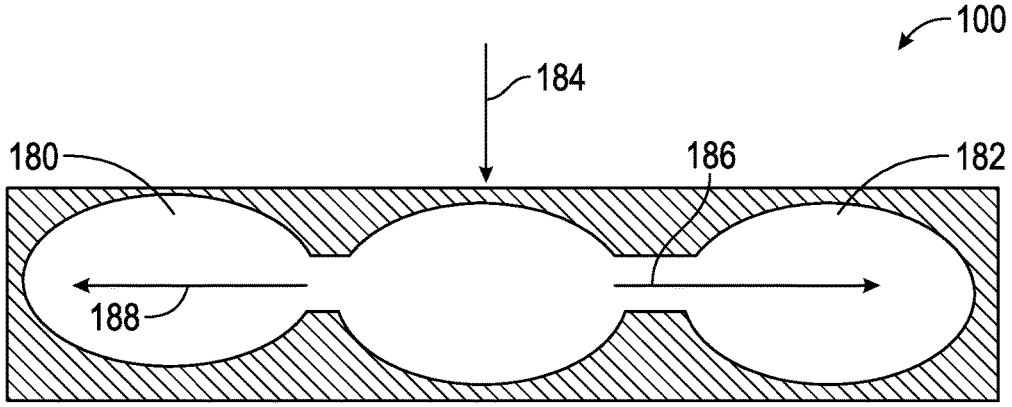
FIG. 4B schematically illustrates representative fluid movement for the FIG. 4A shock protector during a shock event.

FIG. 4B illustrates fluid movement during a shock event. The fluid 180 is shown in a cell structure 182. The fluid may be a liquid, a gas, a gel, a grease, or any other substance that can flow. A shock 184 is shown in what will be referred to as an axial direction. The fluid 180 reacts by flowing in a non-axial direction shown by arrows 186, 188. The arrows 186, 188 are non-parallel with the direction of the shock 184. As shown, this non-axial direction may be orthogonal or the flow vector may have an orthogonal and axial component. The non-axial movement of the fluid deflects the energy of the shock event to thereby protect the electronics module 24.

The FIG. 4B shock protector 100 may use a cell structure 182 that is either open or closed. That is, the cell structure 182 may be permeable and allow fluid to circulate around the electronics module 24 through interconnected pores. The cell structure 182 may also be closed. In the closed cell structure 182, the fluid may be trapped in cavities that deform (e.g., from a circle to an oval).

In embodiments not shown, the fluid may be a film between two surfaces. One or both of the surfaces may be coated with a material that chemically or physically interacts with the grease. For example, a grease film may be interposed between two coated plates. Reducing the gap between the plates forces a lateral movement of the grease film.

Figure 5:
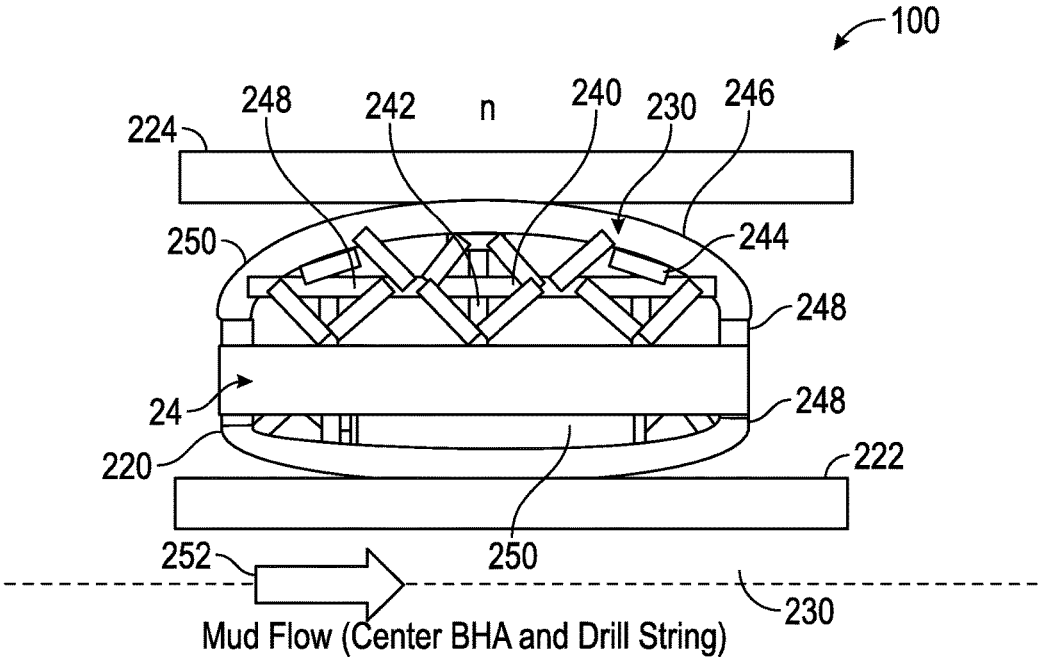
FIG. 5 schematically illustrates one embodiment of a shock protector that uses a lattice structure according to the present disclosure.

Referring now to FIG. 5, there is shown still another exemplary shock protector 100 according to the present disclosure for protecting an electronics module 24 from shock and vibration. In this arrangement, the module 24 is positioned in an annular space 220 between an inner tubular 222 and an outer tubular 224. The drilling fluid flows through a bore 230 of the inner tubular 222. The shock protector 100 may use a lattice 230 to dissipate shock energy and to transfer shock energy around the module 24. The lattice 230 may also be engineered to have ESD protection characteristics, thermal conductivity and/or heat dissipation characteristics.

The lattice 230 may use a complex three dimensional architecture that is adapted to manage multi-axial shock loadings. The architecture may include a number of members configured to transfer primarily bending, primarily tension, and/or primarily compression loadings. By "primarily," it is meant that the member is specifically engineered for a specific type of loading: e.g., a truss 240 or other similar triangular structure that is constructed with straight members whose ends are connected at joints and oriented to handle tension and compression loads; columns 242 for transmitting compression loads; a base 244 for supporting the columns 242 and other structural members; a dome 246 that functions as an outer or external protective body; a girt 248 or horizontal beam for stabilizing a primary structure (e.g. column 242); and gusset plates 248 or similar relatively thick and rigid sheets for connecting girts 248 beams to columns 242 or to connect truss members 240. These features may all have different orientations, connections (e.g., fixed versus articulated), and shapes (e.g., plates, rods, strips, bars, etc.). During shock loadings, the lattice 230 communicates the loadings around the module.

In certain embodiments, one or more fastening members 250 such as latches may be used for quick assembly or disassembly of the packaging of the module 24. The fastening member 250 may be used to lock together the dome 246 and the other described structural elements. Some embodiments may also include a thermal coupling pad 250 that draws heat away from the module 24 and conveys the heat sink such as the flowing drilling fluid 252.

Figure 6A:
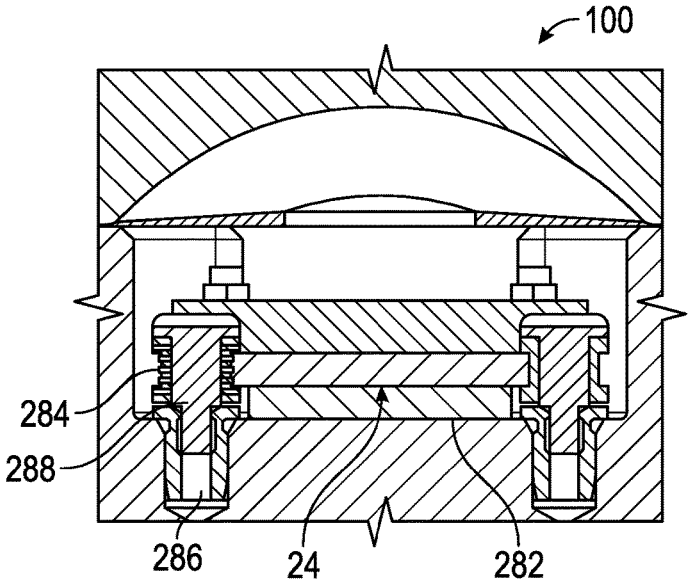
FIG. 6A schematically illustrates one embodiment of a shock protector that uses a resilient grommet according to the present disclosure.
Figure 6B:
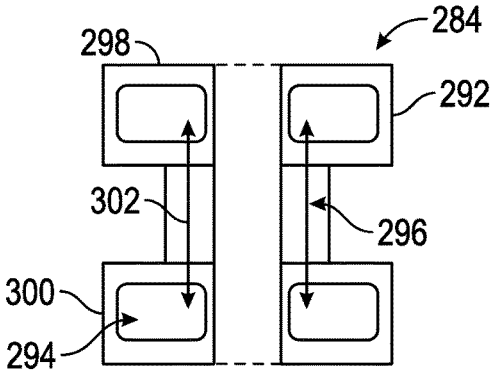
FIG. 6B schematically illustrates one embodiment of a resilient grommet that uses a fluid according to the present disclosure.
Figure 6C:
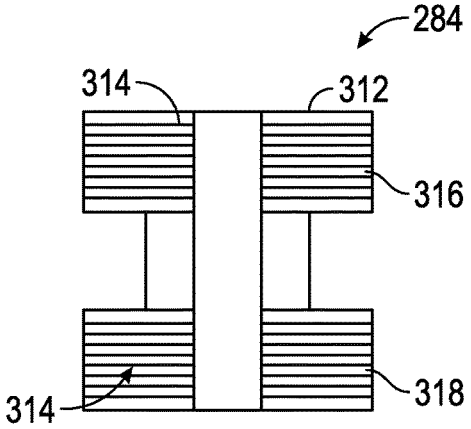
FIG. 6C schematically illustrates one embodiment of a resilient grommet that uses multiple resilient layers according to the present disclosure.

Referring now to FIG. 6A-C, there is shown still another embodiment of a shock protector 100 according to the present disclosure for protecting a module 24. The shock protector 100 may include a pad 282 and one or more grommets 284. The pad 282 may be formed of a visco-elastic material and inserted between the module 24 and a surrounding base 286. The grommet 284 may be formed as a sleeve-like tubular that surrounds a fastener 288 that secures the module 24 to the base 286 through a suitable attachment (e.g., threaded connection). As discussed below, the grommets 284 allow the connection between the module 24 and the base 286 to be resilient.

FIG. 6B illustrates one configuration of a grommet 284 that includes an enclosure 292 and a porous material 294. The porous material 294 may be distributed in a flow channel 296 that connects an upper compartment 298 with a lower compartment 300. The enclosure 296 is sufficiently deformable to allow volume changes in the compartments 298, 300. A viscous fluid 302, such as grease, flows between the compartments 294, 296 during the volume changes. This fluid flow may be used to dampen and absorb vibrations as generally described in connection with the shock absorber described in connection with FIGS. 4A and B.

FIG. 6C illustrates another configuration of a grommet 284 that includes an enclosure 312 and a layered body 314 disposed in an upper compartment 316 with a lower compartment 318. The enclosure 296 is sufficiently deformable to transmit loadings to the layered bodies 314. The layered bodies 314 may be constructed in the same manner and dampen/absorb vibrations as generally described in connection with the shock protector described in connection with FIGS. 3A and B.

Figure 6D:
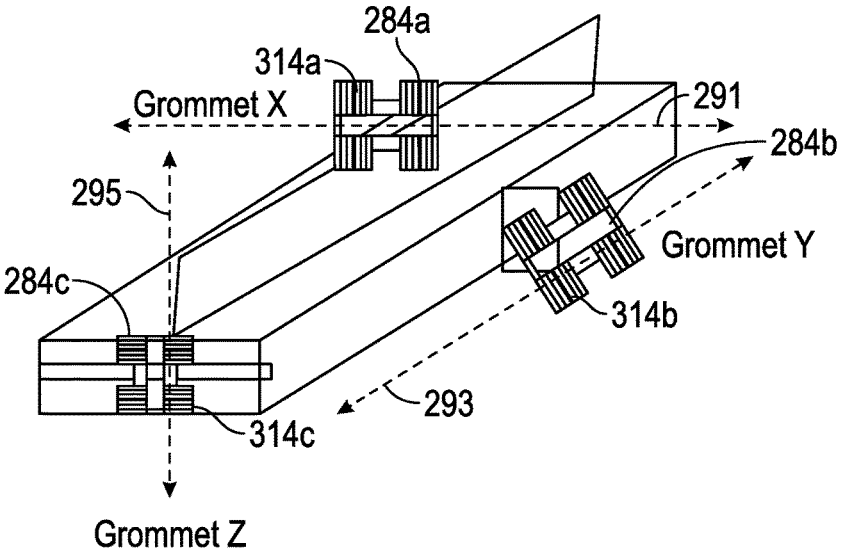
FIG. 6D isometrically illustrates a embodiment according to the present disclosure that uses multiple resilient grommets oriented along different planes.

FIG. 6D illustrates another configuration wherein a plurality of grommet 284*a-c* are arranged to provide shock and vibration management along multiple axes; e.g., an x-axis 291, a y-axis 293, and a z-axis. The grommets 284*a-c* each have layered bodies 314*a-c*. The layered bodies 314*a-c* may be constructed in the same manner and dampen/absorb vibrations as generally described in connection with the shock protector described in connection with FIGS. 3A and B. In this embodiment, each of the layered bodies redirect the energy of a shock event along a different plane. Thus, layered body 314*a* may direct energy along a plane that is non-parallel with the x-axis 291, layered body 314*b* may direct energy along a plane that is non-parallel with the y-axis 293, and layered body 314*c* may direct energy along a plane that is non-parallel with the z-axis 295.

Figure 7A:
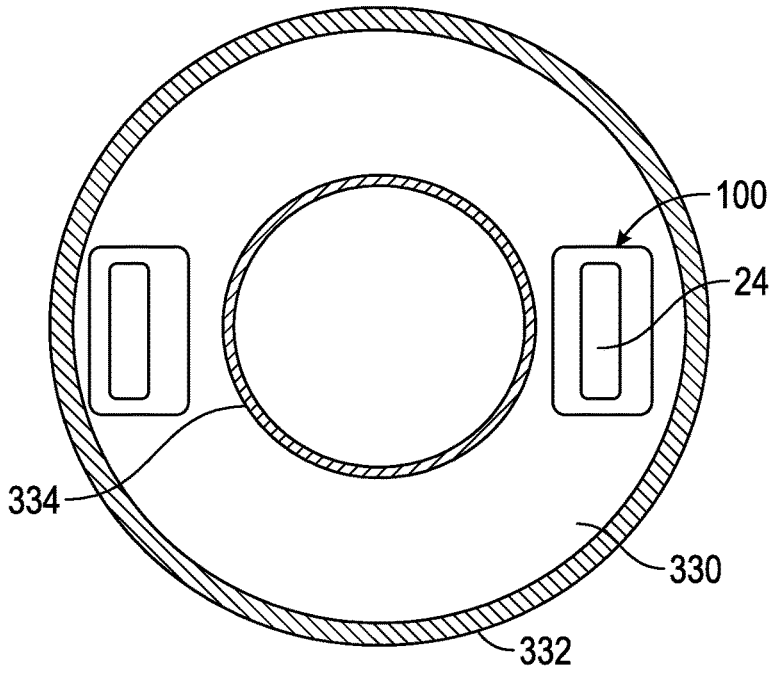
FIG. 7A schematically illustrates the positioning of a shock protector and associated electronics module in a drill string annulus.

Embodiments of the present disclosure may be used anywhere in and along a drill string 12. As discussed previously in connection with FIGS. 2A and B, the shock protector 100 and associated electronics module 24 may be positioned inside a stream of the flowing drilling fluid. Referring to FIG. 7A, the shock protector 100 and associated module 24 may be positioned in an annulus 330 between an outer tubular 332 and an inner tubular 334. The drilling fluid may flow through the bore of the inner tubular 324.

Figure 7B:
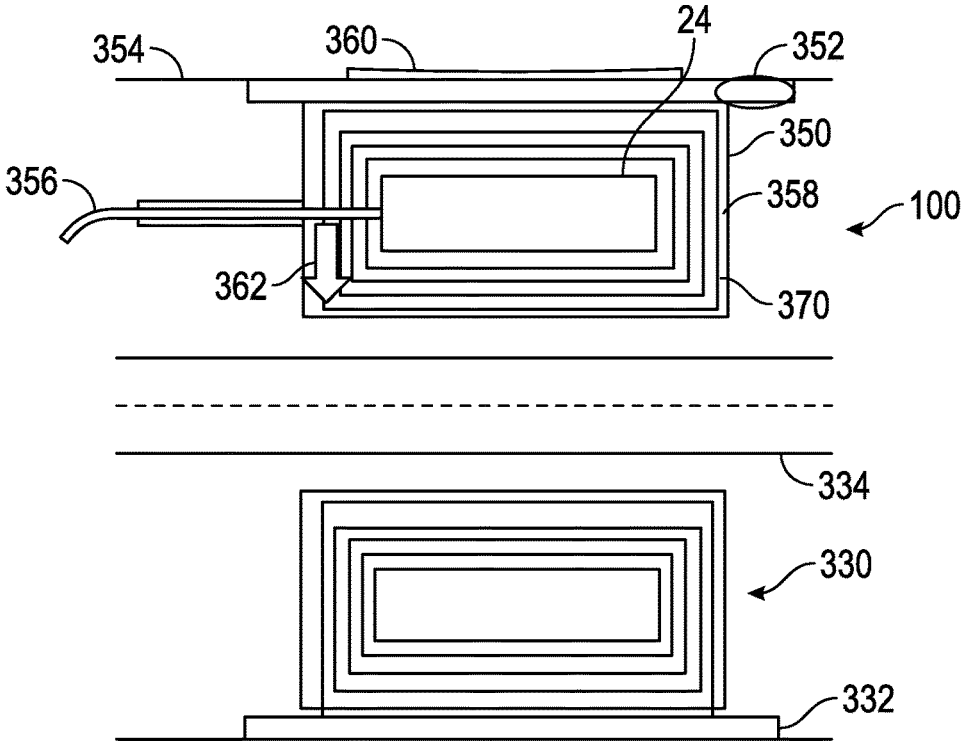
FIG. 7B schematically illustrates an exemplary shock protector that is used to protect an electronics module that is mounted directly to a section of a drill string.

FIG. 7B shows a shock protector 100 and associated module 24 may be positioned in an annulus 330 between an outer tubular 332 and an inner tubular 334. The drilling fluid may flow through the bore of the inner tubular 324. In this embodiment, the shock protector 100 and the associate module 24 are fixed on a pocket 350 formed in the other tubular 332. The module 24 may be positioned in a package housing 370. The pocket 350 may be a section of the outer tubular 332 that has been cut away. The pocket 350 may be secured using a hatch cover 352. Access to the electronics module 34 may be through a routing tube 354 and wiring 356 354 routed to other tool functional modules in the Bottom hole assembly (BHA) or probe assembly. As described previously, the shock protector 100 has a layered body 358, which may be any of the layered bodies described previously. During a shock event 360, the layered body 358 redirects the shock energy around the module 24 as shown by arrow 362.

Figure 7C:
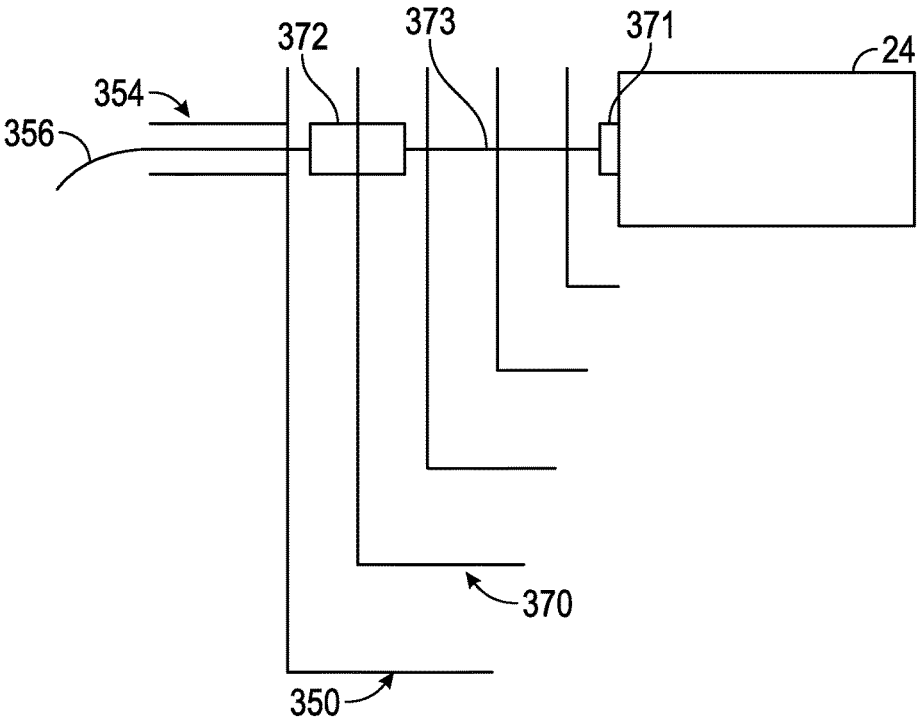
FIG. 7C schematically illustrates the electrical connections that may be sued in connection with shock protectors according to the present disclosure.

Referring now to FIG. 7C, the protective package housing 370, which is may be metallic (e.g., Kovar, stainless steel, titanium, etc. . . . ), supports the hatch cover 352 during deflection due to a shock event 360 or external borehole pressure. The housing 370 can include hermetically sealed connectors 371 for wires and conductors that provide the module 24 with electrical communication with modules (not shown) external to the module 24. The housing 370 also includes through a hermetically sealed connector or a pressure feed-through connector 372 for allowing electrical communication through the package housing 370. A wire connection 373 in the form of a wire bundle, flexible circuit, conductors ribbon, etc. provides signal and/or data communication between the connectors 371 and 372. The connectors 372 connect with external wiring 356 installed and guided through a BHA wiring routing path 354 such as tubes, cut away, bored routing pathways inside the BHA, etc.

The package housing 370 fits tight inside the hatch pocket 350 and is designed to flex as the hatch cover 352 is deformed during impact or external borehole pressure 360. The housing package 370 and the protective layers 358 do not allow the stress and strain deflections imposed on the housing package 370 to be coupled to the module 24. Thus, the housing package 370 and the protective layers 358 prevent the module 24 from bending or being mechanically stressed in addition to minimizing vibration and shock mechanical energy that may be transferred to the module 24.

Figure 7D:
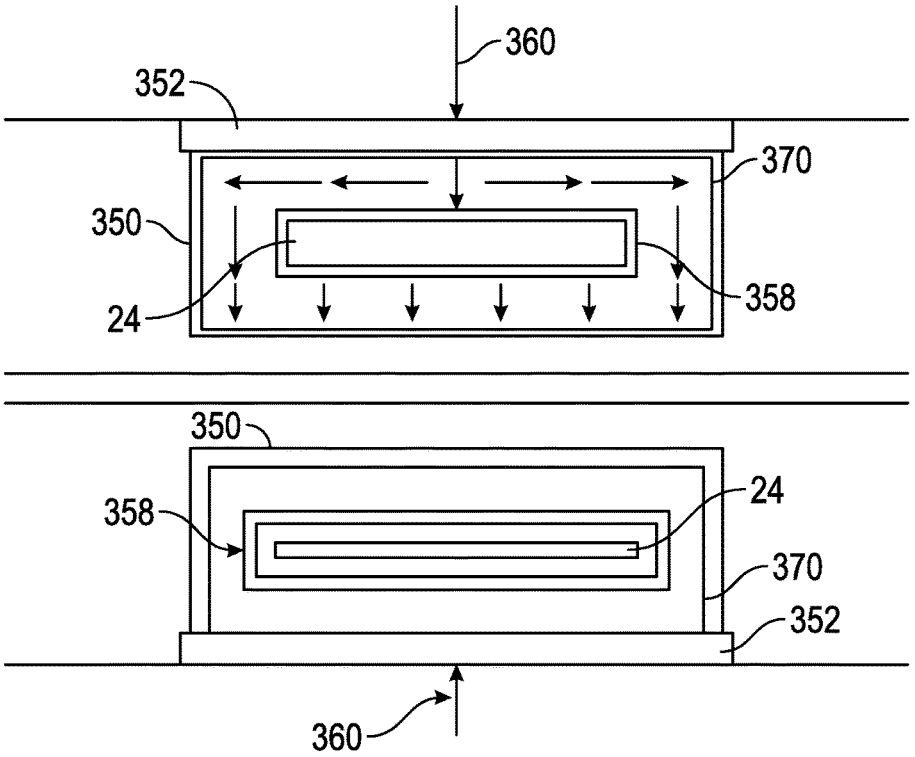
FIG. 7D-E schematically illustrate an exemplary shock protector according to embodiments of the present disclosure that may be used with a packaging module positioned in a hatch.

Referring now to FIG. 7D, the protective package housing 370 of the module 24, which is installed inside the hatch pocket 350, serves as a mechanical path load. The package housing 370 acts as a structural working member inside the hatch pocket 350 and supports the hatch cover 352 from collapsing inward under external borehole pressure or impact 360.

Figure 7E:
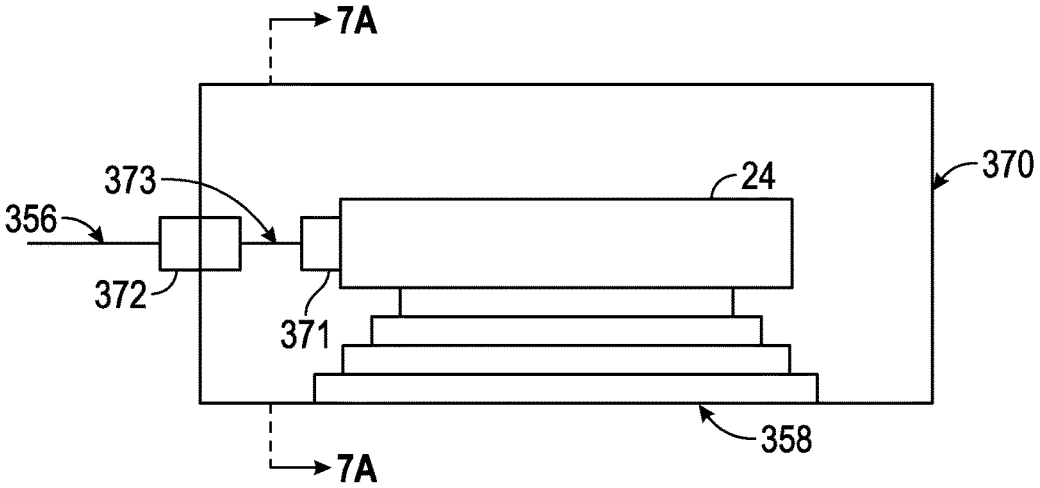
Figure 7F:
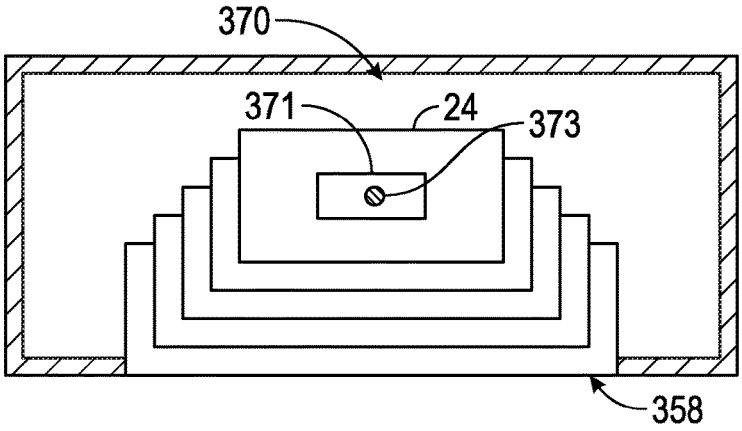
FIG. 7F schematically illustrates a sectional side view of the FIG. 7E embodiment.

Referring to FIG. 7E, the module 24 may be mounted inside a package housing 370 and internally mounted on a substrate of layers 358. The layers 358 may be installed in one side of the module 24. Also, the substrate layers 358 may be extended to provide attachment to the sides of the module 24 as shown in FIG. 7F.

While the foregoing disclosure is directed to the one mode embodiments of the disclosure, various modifications will be apparent to those skilled in the art. It is intended that all variations be embraced by the foregoing disclosure.

We claim:

1. An apparatus for protecting a module used in a borehole, comprising:

a plurality of shock protection elements associated with the module, the plurality of shock protection elements cooperatively having a macroscopic non-linear spring response to an applied shock event, wherein the plurality of shock protection elements includes at least:

an enclosure; and a dampener connecting the module with the enclosure, the dampener having a plurality of discrete, compressible layers, wherein a geometry and material for each layer is configured to respond to a different range of a shock and vibration frequency spectrum.

2. The apparatus according to claim 1, further comprising a drill string section having a bore with fluid, and wherein the enclosure is a pressure barrel positioned in the drill string section, the pressure barrel being surrounded by and immersed in the fluid in the bore of the drill string; and wherein all of the plurality of discrete layers enclose the module on at least two sides.

3. The apparatus according to claim 1, wherein the dampener includes at least one of: (i) a viscoelastic material, and (ii) a material having both viscous and elastic characteristics when undergoing deformation.

4. The apparatus according to claim 3, wherein the viscoelastic material is a thermoset, polyether-based, polyurethane.

5. The apparatus of claim 1, wherein the dampener includes a lattice structure.

6. The apparatus of claim 1, further comprising:

a conveyance device configured to be disposed in the borehole; and a well tool positioned along the conveyance device, wherein the module is disposed in the well tool.

7. The apparatus according to claim 1, wherein the plurality of discrete, compressible layers completely enclose the module.

8. The apparatus according to claim 1, wherein the plurality of discrete, compressible layers are sequentially energized and compressed during one of a shock event and a vibration event.

9. The apparatus according to claim 1, wherein the plurality of discrete, compressible layers includes at least three layers separating the enclosure and the module.

10. The apparatus according to claim 1, wherein at least two layers of the plurality of discrete, compressible layers are serially positioned between the enclosure and the module.

11. An apparatus for protecting a module used in a borehole, comprising:

a plurality of shock protection elements associated with the module, the plurality of shock protection elements cooperatively have a macroscopic non-linear spring response to an applied shock event, wherein the plurality of shock protection elements includes at least:

an enclosure; and a dampener connecting the module with the enclosure, wherein the dampener includes a circulating fluid.

12. The apparatus according to claim 11, wherein the fluid flows completely around the module.

13. The apparatus according to claim 11, wherein the dampener includes a porous media in which the fluid resides.

14. The apparatus according to claim 11, wherein the dampener includes a pair of opposing surfaces and cell structures formed between the opposing surfaces, wherein the fluid flows through the cell structures.

15. The apparatus according to claim 11, wherein the fluid flows in a direction that is non-parallel to a direction of the applied shock event.

16. The apparatus according to claim 15, wherein the fluid flow aligns with the direction of the applied shock event after being non-parallel.

17. A method for protecting a module used in a borehole, comprising:

enclosing the module within a plurality of shock protection elements, wherein the plurality of shock protection elements includes at least: an enclosure and a dampener connecting the module with the enclosure, the dampener having a plurality of discrete layers;

disposing the module in the borehole;

subjecting the module to a shock event; and sequentially in time energizing and compressing each individual layer of the plurality of layers of the dampener, wherein the plurality of shock protection elements cooperatively have a macroscopic non-linear spring response to the shock event and each layer responds to a different range of a shock and vibration frequency spectrum.

18. The method according to claim 17, wherein the plurality of discrete layers of different materials enclose the module.

* * * * *